US009402289B1

(12) United States Patent
Jungwirth

(10) Patent No.: US 9,402,289 B1
(45) **Date of Patent: *Jul. 26, 2016**

(54) DIMMING CONTROL FOR ILLUMINATION SYSTEMS

(71) Applicant: Paul Jungwirth, Burnaby (CA)

(72) Inventor: Paul Jungwirth, Burnaby (CA)

(73) Assignee: Cooledge Lighting, Inc., Richmond (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/576,507

(22) Filed: Dec. 19, 2014

Related U.S. Application Data

(60) Provisional application No. 61/918,401, filed on Dec. 19, 2013.

(51) Int. Cl.
*H05B 33/08* (2006.01)
*H05B 37/02* (2006.01)

(52) U.S. Cl.
CPC ..... *H05B 33/0851* (2013.01); *H05B 37/0281* (2013.01)

(58) Field of Classification Search
CPC ..... H05B 33/0851; H05B 37/0281
USPC ..... 315/307
See application file for complete search history.

(56) References Cited

U.S. PATENT DOCUMENTS

| | | | | |
|---|---|---|---|---|
| 9,113,513 | B1 * | 8/2015 | Jungwirth | H05B 33/0827 |
| 2011/0012530 | A1 * | 1/2011 | Zheng | H05B 33/0815 315/294 |
| 2011/0080110 | A1 * | 4/2011 | Nuhfer | H05B 33/0815 315/291 |
| 2015/0208469 | A1 * | 7/2015 | Coetzee | H05B 33/08 315/307 |
| 2015/0305116 | A1 * | 10/2015 | Vora | H05B 37/029 315/292 |

* cited by examiner

*Primary Examiner* — Dylan White
(74) *Attorney, Agent, or Firm* — Morgan, Lewis & Bockius LLP

(57) ABSTRACT

Changes in light intensity emitted by an illumination system are controlled by receiving signals to initiate dimming, determining a present value of the output drive signal, computing a change increment for the output drive signal based on the present value of the output drive signal, and changing the output drive signal by the change increment. The change increment is a first value if the present value of the output drive signal is less than a threshold, and the change increment is a second value greater than the first value if the present value of the output drive signal is greater than the threshold.

15 Claims, 10 Drawing Sheets

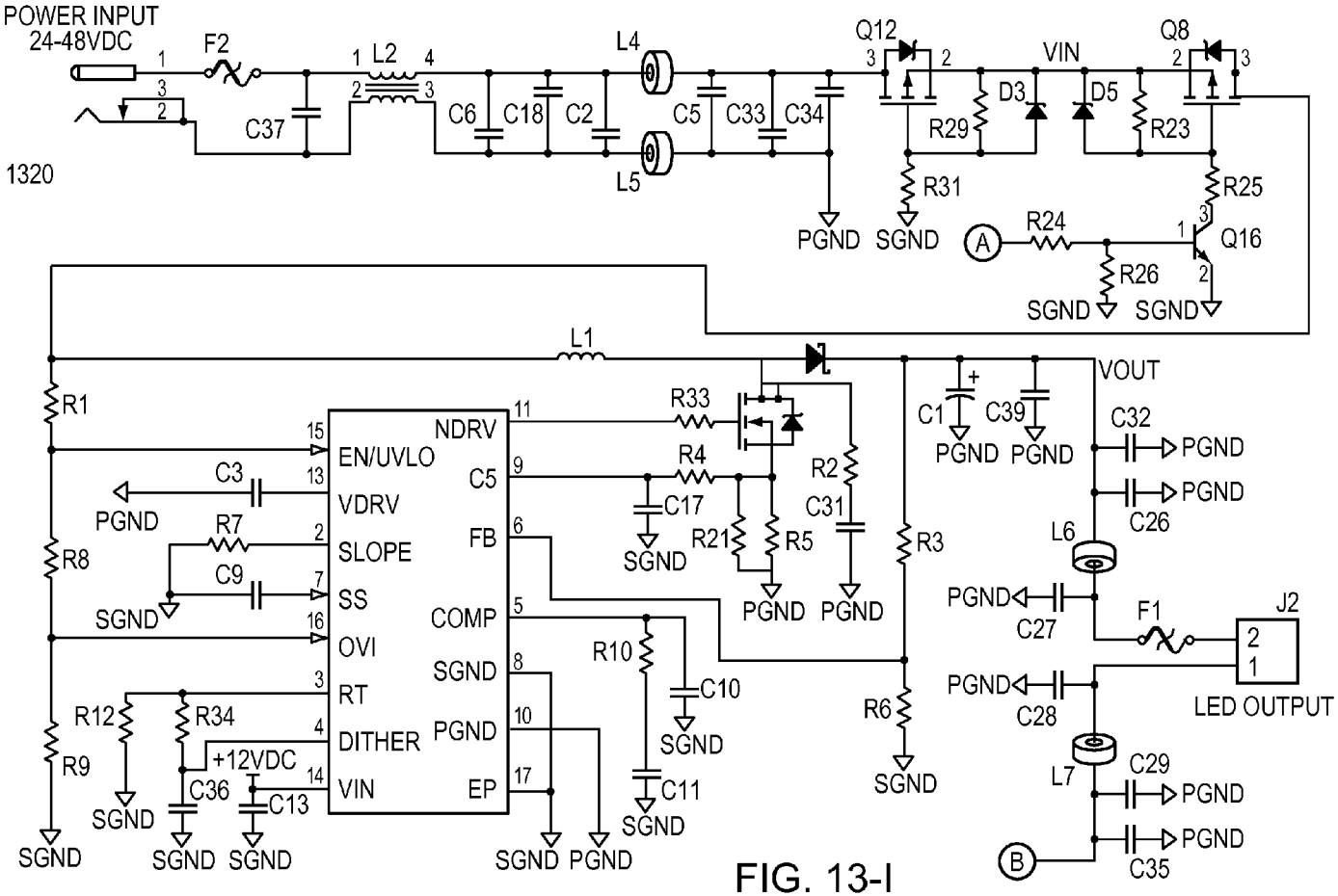
FIG. 13-I

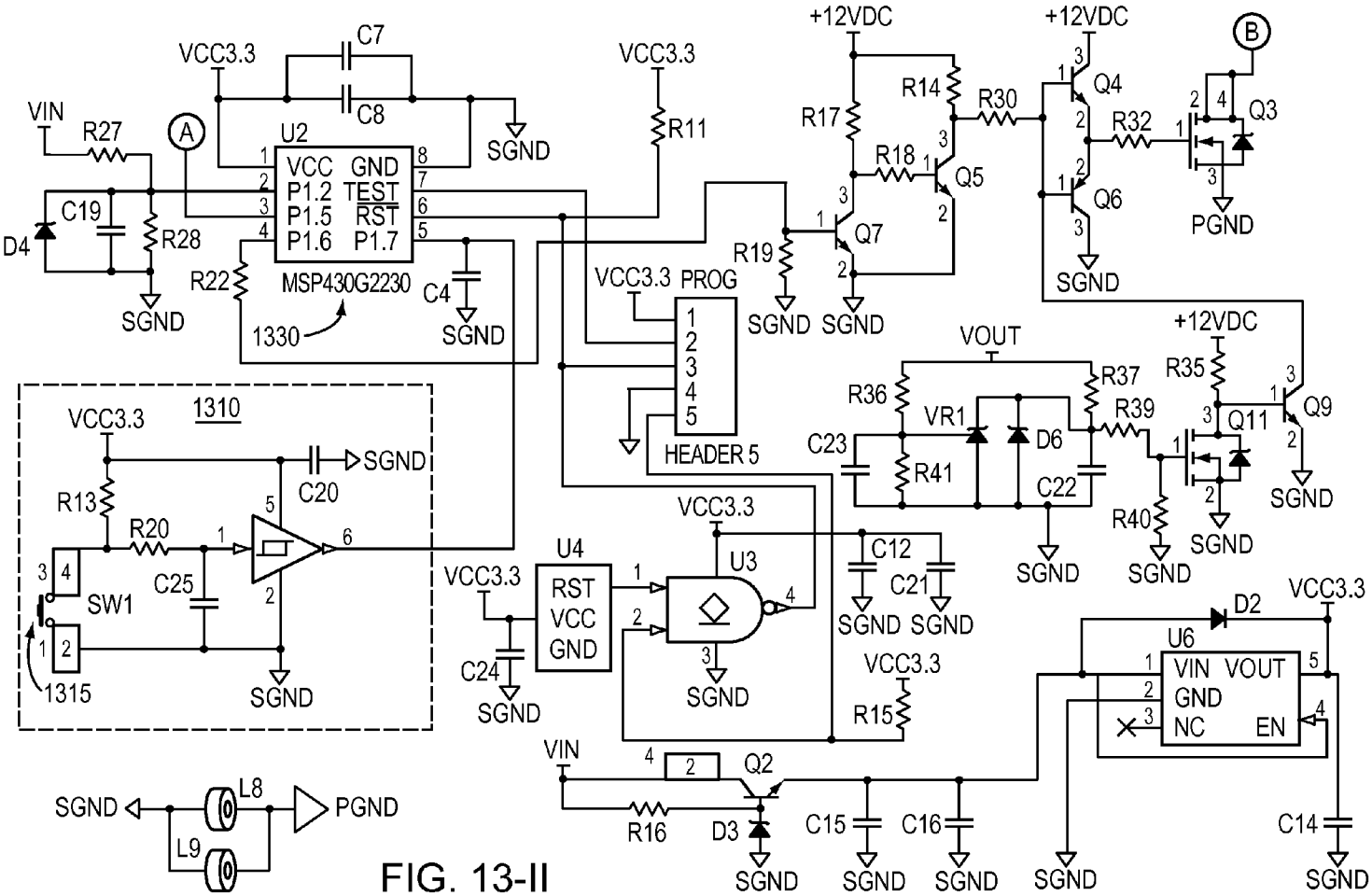
FIG. 13-II

DIMMING CONTROL FOR ILLUMINATION SYSTEMS

RELATED APPLICATION

This application claims the benefit of and priority to U.S. Provisional Patent Application No. 61/918,401, filed Dec. 19, 2013, the entire disclosure of which is incorporated herein by reference.

FIELD OF THE INVENTION

In various embodiments, the present invention generally relates to control of light intensity levels in lighting systems.

BACKGROUND

In many lighting systems it is desirable to have the ability to change the light intensity level (i.e., dim the light) over a wide range of intensities. A number of approaches to dimming have been utilized conventionally. One approach for AC-powered systems is the use of a phase-cut technique, in which portions of the AC signal driving the light emitter (for example, an incandescent lamp) are progressively zeroed, resulting in progressively less power being applied to the light emitter and thus a reduction in the light intensity. Phase-cut systems are typically not directly applicable to DC-driven light emitters such as light-emitting diodes (LEDs). In particular, LED-based lighting systems often have drivers that require a minimum level of power, and if the power is reduced through phase-cut dimming, the driver is starved for power at low dimming (light) levels, resulting in inefficiency, inability to operate, and/or flickering of the light.

Furthermore, for larger lighting systems, it is desirable to provide an interface to a control system that enables the use of one control protocol to address multiple luminaires (or other illumination systems). Such systems (for example, Dali or DMX) typically use a control signal separate from the power supply, for example a 0-10V signal where the value of the voltage signifies the desired light intensity level or a digital dimming signal. In such a system, the light intensity level may be controlled by varying the power to the light-emitting element in a number of ways. In one approach, the current or voltage level supplied to the lighting elements is varied in response to the control signal. In another approach, the power to the lighting elements is modulated, that is, the duty cycle—i.e., the fraction of a signal period during which the signal is non-zero—is varied in response to the control signal. This is similar to phase cut dimming, but in this case full power is applied to the lighting power supply and its output is modulated in response to the control signal. In some approaches the analog control signal is converted to a digital signal, which is then converted to a light intensity level. The human eye is relatively sensitive to changes in light intensity, and also is not linearly responsive to light intensity levels. Thus, basic control systems may achieve the ability to change the light intensity level, but produce undesired visual effects such as flicker, obvious "steps" in the intensity level, and/or response times that are too slow or too fast. Basic control systems also may not provide the desired controllability at low light intensity levels. This is particularly true for systems that require fine control of the light level, for example the ability to dim the power to the lighting elements or the light intensity to 5% or 1% of the full-scale (i.e., maximum) value.

For example, consider the case of a 0-10 V analog control input being converted to a digital signal by an analog-to-digital converter (ADC) and then applied to the output by means of an n-bit pulse-width-modulation (PWM) generator. The minimum step level (i.e., the ADC resolution) is generally defined as $10V/(2^n-1)$. Many common systems, for example a microcontroller used in the dimming system, utilize a 10-bit PWM generator. This results in 1024 steps, which means each step is about 100%/1024, or about 0.1%, of full scale.

If the output of the ADC is directly applied, a full-scale change in input signal, for example from off to full on (0V to 10V), will immediately send a full power signal to the lighting system. This may present several problems. First, it creates an immediate change in light intensity that may be faster than desired. From a visual perspective, it is preferable to have a smooth transition from one light intensity level to another, rather than a discontinuous step transition. Additionally, a full power signal imposes a very large step load on the power supply of the system, which may potentially damage the power supply or reduce its lifetime, or it may cause a temporary change in output voltage before it recovers, and this output voltage change may result in an unintended intensity change of the load.

One way to eliminate instantaneous changes is to sample the control signal and provide a rolling average of the sampled values to the system. If the sample period is $\tau_s$ with $n_s$ samples in the rolling average, then it will require a time of $\tau_s \times n_s$ for a change to fully propagate through the ADC. For example, if the sample period is 25 milliseconds (ms) and the number of samples in the rolling average is 32 it will take $25 \times 32 = 800$ ms for the light to complete its change in intensity.

However, in this case the minimum step level change in the light output is now determined by the change in input to the ADC divided by the number of samples rather than by the ADC resolution. The situation where the step size is largest and most visible is if the system is changed from off to full power or vice versa. In this case, the input is changed by 100%, and the step size presented to the PWM generator is 100%/32=3.125%. This is a relatively large change in intensity, which may be visible as unacceptable discrete steps (or "steppiness") in the light intensity. Herein, steppiness of emitted light is defined as the presence of discontinuous jumps (up or down) in intensity during changes in intensity (e.g., dimming) that are visibly apparent to the human eye. Conversely, light intensity changes are "smooth" or "substantially smooth" if lacking such visibly apparent discontinuous changes in intensity.

The steppiness may be reduced by increasing the number of samples $n_s$. However, this has the disadvantage of increasing the response time. If $n_s$ is increased by a factor of 6 to reduce the step size from 3.125% to about 0.5%, then the response time will increase by a factor of 6 to about 4.8 seconds, which may be undesirably long. Decreasing the sample period and increasing the number of samples may also reduce steppiness; however, this approach generates a large number of samples that need to be stored in the controller memory. Many low-cost controllers lack sufficient memory to accommodate this approach.

In view of the foregoing, a need exists for systems and techniques enabling the smooth, visually pleasing, flicker-free, and accurate change in light intensity in lighting systems with appropriate response times.

SUMMARY

Embodiments of the present invention involve level and time conditioning of the output duty cycle in response to the input control signal in order to achieve improved dimming performance in a lighting system, specifically to achieve appropriate time response and smooth, non-stepped changes in light intensity level. In various embodiments of the present invention, steppiness is reduced or eliminated (i.e., the transition in light intensity is substantially smoothed) while maintaining desirable response times by using at least one of two techniques. First, the PWM increment is adaptively changed based on the relative size of the control signal change. Second, the maximum PWM increment is limited to a value that is visually acceptable, so as to not produce visual steppiness when the light intensity is changed. The adaptive change in the PWM increment permits appropriate response times over a wide range of changes in the input control value. For example, if the change in the input control signal is relatively large, then the PWM increment is relatively large, while if the change in the input control signal is relatively small, then the PWM increment is relatively smaller. As utilized herein, "dimming" may refer to increasing or decreasing the light intensity of an illumination device unless otherwise indicated.

As utilized herein, the term "light-emitting element" (LEE) refers to any device that emits electromagnetic radiation within a wavelength regime of interest, for example, visible, infrared or ultraviolet regime, when activated, by applying a potential difference across the device or passing a current through the device. Examples of LEEs include solid-state, organic, polymer, phosphor-coated or high-flux LEDs, microLEDs (described below), laser diodes or other similar devices as would be readily understood. The emitted radiation of a LEE may be visible, such as red, blue or green, or invisible, such as infrared or ultraviolet. A LEE may produce radiation of a spread of wavelengths. A LEE may feature a phosphorescent or fluorescent material for converting a portion of its emissions from one set of wavelengths to another. A LEE may include multiple LEEs, each emitting essentially the same or different wavelengths. In some embodiments, a LEE is an LED that may feature a reflector over all or a portion of its surface upon which electrical contacts are positioned. The reflector may also be formed over all or a portion of the contacts themselves. In some embodiments, the contacts are themselves reflective.

An LEE may be of any size. In some embodiments, an LEE has one lateral dimension less than 500 μm, while in other embodiments an LEE has one lateral dimension greater than 500 μm. Exemplary sizes of a relatively small LEE may include about 175 μm by about 250 μm, about 250 μm by about 400 μm, about 250 μm by about 300 μm, or about 225 μm by about 175 μm. Exemplary sizes of a relatively large LEE may include about 1000 μm by about 1000 μm, about 500 μm by about 500 μm, about 250 μm by about 600 μm, or about 1500 μm by about 1500 μm. In some embodiments, an LEE includes or consists essentially of a small LED die, also referred to as a "microLED." A microLED generally has one lateral dimension less than about 300 μm. In some embodiments, the LEE has one lateral dimension less than about 200 μm or even less than about 100 μm. For example, a microLED may have a size of about 225 μm by about 175 μm or about 150 μm by about 100 μm or about 150 μm by about 50 μm. In some embodiments, the surface area of the top surface of a microLED is less than 50,000 $\mu m^2$ or less than 10,000 $\mu m^2$. The size of the LEE is not a limitation of the present invention, and in other embodiments the LEE may be relatively larger, e.g., the LEE may have one lateral dimension on the order of at least about 1000 μm or at least about 3000 μm. In some embodiments the LEE may emit white light or substantially white light.

In an aspect, embodiments of the invention feature a method for controlling changes in light intensity in an illumination system that emits light in response to an output drive signal updatable at a plurality of times separated by a time period P2 (i.e., the output drive signal is updatable at a frequency corresponding to the inverse of time period P2). In step (A), a dimming signal indicating a desired light intensity is received. In step (B), the dimming signal is sampled with a sampling period P1 (i.e., sampled at a frequency corresponding to the inverse of sampling period P1), and the one or more dimming signal samples are averaged over a time t1 (i.e., samples are sampled during the time t1 after each sampling period P1), thereby determining a first average dimming signal. The time t1 is greater than or equal to the sampling period P1, and the sampling period P1 is greater than the time period P2. In step (C), the dimming signal is sampled with the sampling period P1 (i.e., sampled at a frequency corresponding to the inverse of sampling period P1), and the one or more dimming signal samples are averaged over a time t2 (i.e., samples are sampled during the time t2 (i.e., a time period at least a portion of which is after the time period t1) after each sampling period P1), thereby determining a second average dimming signal. The time t2 is greater than or equal to the sampling period P1, and the sampling period P1 is greater than the time period P2. In step (D), a change increment for the output drive signal is computed by multiplying the difference between the first and second average dimming signals by (P2/P1). In step (E), the output drive signal is changed by the change increment. In step (F), steps (A)-(E) are repeated until the light intensity emitted by the illumination system substantially matches the desired light intensity indicated by the dimming signal.

Embodiments of the invention may include one or more of the following in any of a variety of combinations. After step (D), the present value of the output drive signal may be determined, and the change increment may be updated based on the present value of the output drive signal. The change increment may be updated to (i) a first value less than the change increment determined in step (D) if the present value of the output drive signal is less than a threshold and (ii) a second value greater than the first value if the present value of the output drive signal is greater than the threshold. The second value may be substantially equal to the change increment determined in step (D). The first value and/or the second value may be capped at a maximum value. The maximum value may be 0.5% or 0.3% of the full-scale range of light intensity (i.e., emittable by the illumination device). In step (F), the dimming signal may be compared to the output drive signal to determine if the light intensity emitted by the illumination system substantially matches the desired light intensity indicated by the dimming signal. The dimming signal may (directly) represent the final desired light intensity, or the dimming signal may represent a desired change in a present light intensity emitted by the illumination system. The output drive signal may be a pulse-width modulated signal. The change increment for the output drive signal may include or consist essentially of a change to a pulse-width modulated duty cycle. The dimming signal may be scaled to match input requirements of an analog-to-digital converter. The dimming signal may be averaged to reduce noise therein. After step (D), the present illumination level of (i.e., light intensity currently being emitted by) the illumination system may be determined, and the change increment may be updated based on the present illumination level. The change increment may be updated to (i) a first value less than the change increment determined in step (D) if the present illumination level is less than a threshold and (ii) a second value greater than the first value if the present illumination level is greater than the threshold. the second value may be substantially equal to the change increment determined in step (D). The first value and/or the second value may be capped at a maximum value. The maximum value may be 0.5% or 0.3% of a full-scale range of light intensity. The time t1 may be substantially equal to the time t2 (i.e., the duration of time periods t1 and t2 may be substantially equal; the time periods t1, t2 themselves are typically different but may partially overlap).

In another aspect, embodiments of the invention feature a method for controlling changes in light intensity in an illumination system that emits light in response to an output drive signal. In step (A), a signal to initiate dimming is received. In step (B), the present value of the output drive signal is determined. In step (C), a change increment for the output drive signal is computed based on the present value of the output drive signal. The change increment is (i) a first value if the present value of the output drive signal is less than a threshold and (ii) a second value greater than the first value if the present value of the output drive signal is greater than the threshold. In step (D), the output drive signal is changed by the change increment.

Embodiments of the invention may include one or more of the following in any of a variety of combinations. The first value and/or the second value may be capped at a maximum value. The maximum value may be 0.5% or 0.3% of a full-scale range of light intensity. The output drive signal may be a pulse-width modulated signal. The change increment for the output drive signal may include or consist essentially of a change to a pulse-width modulated duty cycle. The dimming signal may be scaled to match input requirements of an analog-to-digital converter. The dimming signal may be averaged to reduce noise therein. A signal to cease dimming may be received. In response to the signal to cease dimming, the output drive signal may be maintained substantially constant (i.e., at a substantially constant value). The signal to cease dimming may include or consist essentially of (i) a cessation in the signal to initiate dimming, (ii) a cessation in change of the signal to initiate dimming, and/or (iii) a cessation signal different from the signal to initiate dimming. Steps (B)-(D) may be repeated until a signal to cease dimming is received. In response to the signal to cease dimming, the output drive signal may be maintained substantially constant (i.e., at a substantially constant value).

In yet another aspect, embodiments of the invention feature a control system for controlling changes in light intensity in an illumination system that emits light in response to an output drive signal. The control system may include or consist essentially of a controller for (i) receiving a dimming initiation signal, (ii) determining a present value of the output drive signal or a present illumination level of light emitted by the illumination system, (iii) computing a change increment for the output drive signal based on the present value of the output drive signal or the present illumination level, and (iv) changing the output drive signal by the change increment. The change increment is (a) a first value if the present value of the output drive signal or the present illumination level is less than a threshold and (b) a second value greater than the first value if the present value of the output drive signal or the present illumination level is greater than the threshold.

Embodiments of the invention may include one or more of the following in any of a variety of combinations. The controller may be configured to receive a signal to cease dimming, and in response thereto, maintain the output drive signal at a substantially constant value. The signal to cease dimming may include or consist essentially of (i) a cessation in the signal to initiate dimming, (ii) a cessation in change of the signal to initiate dimming, and/or (iii) a cessation signal different from the dimming initiation signal. The control system may include a conditioner for modifying the output drive signal to match the input requirements of a driver. The control system may include a driver for driving one or more light-emitting diodes based on the output drive signal. The output drive signal may be a pulse-width modulated signal. The change increment for the output drive signal may include or consist essentially of a change to a pulse-width modulated duty cycle.

In another aspect, embodiments of the invention feature a control system for controlling changes in light intensity in an illumination system that emits light in response to an output drive signal updatable at a plurality of times separated by a time period P2. The control system includes or consists essentially of an analog-to-digital converter and a controller. The analog-to-digital converter receives a dimming signal indicating a desired light intensity and converts the dimming signal to a digital representation thereof. The controller (i) receives the digital representation of the dimming signal, (ii) samples the dimming signal with a sampling period P1 and averages one or more dimming signal samples over a time t1, thereby determining a first average dimming signal, wherein (a) the time t1 is greater than or equal to the sampling period P1, and (b) the sampling period P1 is greater than the time period P2, (iii) samples the dimming signal with a sampling period P1 and averages one or more dimming signal samples over a time t2, thereby determining a second average dimming signal, wherein (a) the time t2 is greater than or equal to the sampling period P1, and (b) the sampling period P1 is greater than the time period P2, (iv) computes a change increment for the output drive signal by multiplying the difference between the first and second average dimming signals by (P2/P1), (v) changes the output drive signal by the change increment, and (vi) repeats steps (i)-(v) until a light intensity emitted by the illumination system substantially matches the desired light intensity indicated by the dimming signal.

Embodiments of the invention may include one or more of the following in any of a variety of combinations. The time t1 may be substantially equal to the time t2. The controller may be configured to (a) determine a present value of the output drive signal and (b) update the change increment based on the present value of the output drive signal. The change increment may be (a) decreased to a first value if the present value of the output drive signal is less than a threshold or (b) updated to a second value greater than the first value if the present value of the output drive signal is greater than the threshold. The second value may be substantially equal to the change increment before the change increment is updated. The first value and/or the second value may be capped at a maximum value. The maximum value may be 0.5% or 0.3% of a full-scale range of light intensity. The controller may be configured to (a) determine a present illumination level of the illumination system and (b) update the change increment based on the present illumination level. The change increment may be (a) decreased to a first value if the present illumination level is less than a threshold or (b) updated to a second value greater than the first value if the present illumination level is greater than the threshold. The second value may be substantially equal to the change increment before the change increment is updated. The first value and/or the second value may be capped at a maximum value. The maximum value may be 0.5% or 0.3% of a full-scale range of light intensity. The dimming signal may represent the final desired light intensity or a desired change in a present light intensity emitted by the illumination system. The output drive signal may be a pulse-width modulated signal. The change increment for the output drive signal may include or consist essentially of a change to a pulse-width modulated duty cycle. The control system may include a scaler (e.g., a "scaling circuit") for scaling the dimming signal to match input requirements of the analog-to-digital converter. The control system may include an averager (e.g., an "averaging circuit") for averaging the dimming signal to reduce noise therein. The control system may include a conditioner for modifying the output drive signal to match the input requirements of a driver. The control system may include a driver for driving one or more light-emitting diodes based on the output drive signal.

In yet another aspect, embodiments of the invention feature a method for controlling changes in light intensity in an illumination system that emits light in response to an output drive signal. A dimming signal indicating a light intensity parameter (e.g., a desired light intensity or a desired change in light intensity) is received. The amount of change in the dimming signal over a period of time t1 is determined, where the change in the dimming signal represents a desired change in the light intensity. A change increment for the output drive signal is computed based on the amount of change in the dimming signal. The change increment is (i) a first value if an amount of change in the value of the dimming signal during a period of time t2 prior to the period of time t1 is less than a threshold and (ii) a second value greater than the first value if an amount of change in the value of the dimming signal during the period of time t2 prior to the period of time t1 is greater than the threshold. The output drive signal is changed by the change increment.

Embodiments of the invention may include one or more of the following in any of a variety of combinations. The dimming signal may represent a final desired light intensity or a desired change in light intensity. After changing the output drive signal by the change increment, a signal to cease dimming may be received. In response to the signal to cease dimming, the output drive signal may be maintained at a substantially constant value. The output drive signal may be a pulse-width modulated signal. The change increment for the output drive signal may include or consist essentially of a change to a pulse-width modulated duty cycle. The amount of change in the dimming signal may include or consist essentially of a change in the phase dimming of the dimming signal. Computing the change increment for the output drive signal may include or consist essentially of computing a rolling average of prior changes in the value of the output drive signal in the time period t2, the rolling average being compared to the threshold. A level of illumination during the period of time t2 may be determined, and the change increment for the output drive signal may be adjusted based on the level of illumination. Adjusting the change increment based on the level of illumination may include or consist essentially of comparing the level of illumination to a second threshold. The first value and/or the second value may be capped at a maximum value. The maximum value may be 0.5% or 0.3% of a full-scale range of light intensity. The dimming signal may be scaled to match input requirements of an analog-to-digital converter. The dimming signal may be averaged to reduce noise therein. The change increment may be varied during a change in the light intensity in accordance with a level of light intensity. Smaller change increments may be used at low light intensity levels and larger change increments may be used at high light intensity levels.

In another aspect, embodiments of the invention feature a control system for controlling changes in light intensity in an illumination system that emits light in response to an output drive signal. The control system includes or consists essentially of an analog-to-digital converter and a controller. The analog-to-digital converter receives a dimming signal indicating a light intensity parameter and converts the dimming signal to a digital representation thereof. The controller (i) receives the digital representation of the dimming signal, (ii) determines an amount of change in the dimming signal over a period of time t1, (iii) computes a change increment for the output drive signal based on the amount of change in the dimming signal, and (iv) changes the output drive signal by the change increment. The change increment is (a) a first value if an amount of change in the value of the dimming signal during a period of time t2 prior to the period of time t1 is less than a threshold and (b) a second value greater than the first value if an amount of change in the value of the dimming signal during the period of time t2 prior to the period of time t1 is greater than the threshold.

Embodiments of the invention may include one or more of the following in any of a variety of combinations. The control system may include a scaling circuit for modifying the dimming signal to match an input range of the analog-to-digital converter. The control system may include a conditioner for modifying the output drive signal to match the input requirements of a driver. The control system may include a driver for driving one or more light-emitting diodes based on the output drive signal. The output drive signal may be a pulse-width modulated signal. The change increment for the output drive signal may include or consist essentially of a change to a pulse-width modulated duty cycle. The amount of change in the dimming signal may include or consist essentially of a change in the phase dimming of the dimming signal. Computing the change increment for the output drive signal may include or consist essentially of computing a rolling average of prior changes in the output drive signal in the time period t2, the rolling average being compared to the threshold. Adjusting the change increment for the output drive signal based on the level of illumination may include or consist essentially of comparing the level of illumination to a second threshold.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. As used herein, the term "substantially" means±10%, and in some embodiments, ±5%. The term "consists essentially of" means excluding other materials that contribute to function, unless otherwise defined herein. Nonetheless, such other materials may be present, collectively or individually, in trace amounts.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

In the following description, various embodiments of the present invention are described with reference to the following drawings, in which:

FIG. 13, presented over two pages as FIG. 13-I and FIG. 13-II for clarity, is an electrical schematic of a control circuit in accordance with various embodiments of the invention.

DETAILED DESCRIPTION

Figure 1A:
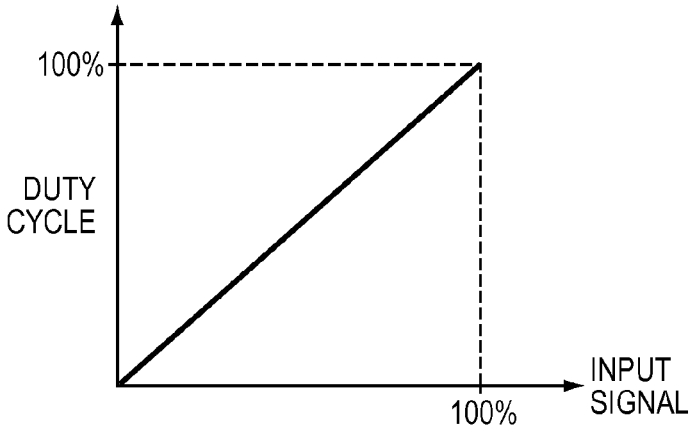
FIGS. 1A and 1B are graphs of dimming profiles.

FIG. 1A is a graph depicting the relationship of an input control signal to an output dimming signal, also known as a dimming curve, for an illumination system. In the illustrated example, the dimming signal is varied by time modulation, i.e., the duty cycle of the power signal supplied to the light-emitting elements is changed in response to the input control signal. This approach is also known as pulse-width modulation (PWM). As may be seen from FIG. 1A, if the input signal is zero, the duty cycle is zero; if the input signal is 100%, then the duty cycle is 100%; and if the input signal is between zero and 100%, the duty cycle changes linearly with the value of the input signal.

Another aspect of dimming is the behavior that occurs at the extremes of light intensity, that is, when the system is supposed to be completely off or 100% on. It is often desirable to have the light intensity be zero at the low end of the dimming control and 100% at the high end of the dimming control. However, with a direct linear response between the input dimming signal and the output to the lighting system, as shown in FIG. 1A, it is possible that variations in the system will not result in exactly a zero input dimming signal, which may result in a non-zero light output in the "off" position. Similarly, system variations may result in a less than 100% output, even with a full-scale input dimming signal, or a full-scale input dimming signal may not even be producible by the system, thus making it impossible to produce 100% output. Furthermore, instability in the least significant bit (LSB) of the ADC may result in a random dithering in the light level, even for a fixed input control signal, a behavior that is particularly noticeable at low light intensity levels.

Figure 1B:
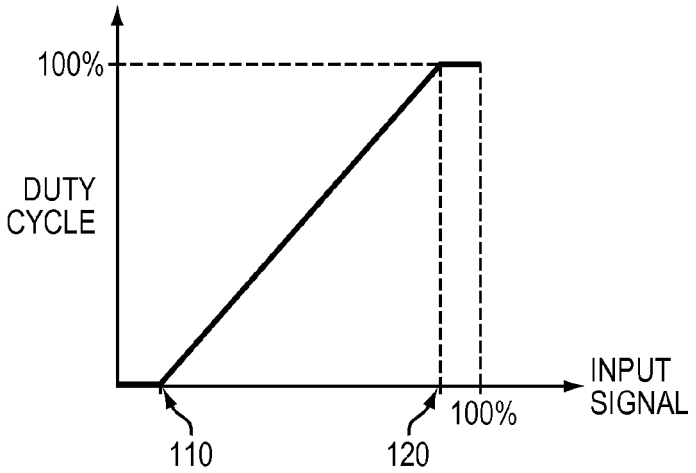

Some deviations to a linear dimming response curve are often introduced at the high and low end to mitigate these issues, for example as shown in FIG. 1B. When the input control signal is zero (off), the duty cycle is zero. The duty cycle remains zero up until an input value 110. When the input signal is above an input signal 120, the duty cycle is set at 100%. Between input signals 110 and 120, there is a linear relationship between the input signal and the output duty cycle. For example, input signal 110 may be about 0.5 V and input signal 120 may be about 9.5-9.75 V for a 0-10 V input control signal.

Embodiments of the present invention involve level and time conditioning of the output duty cycle in response to the input control signal in order to achieve improved dimming performance, specifically to achieve appropriate time response and smooth, non-stepped changes in light intensity level. In various embodiments, the input-to-output transfer function may be linear, logarithmic, exponential, or have another functional or arbitrary relationship.

In various embodiments of the present invention, the steppiness is reduced or eliminated while maintaining desirable response times by two techniques. First, the PWM increment, which is the change applied to the duty cycle, is adaptively adjusted based on the relative size of the control signal change. Second, the PWM increment is prevented from increasing above a maximum level. Changing the PWM increment permits an adaptive adjustment in the response time, based on the change in input control signal value. Larger changes in input control value result in larger PWM increments, thus speeding up the response time. Visual steppiness is reduced or eliminated by capping the PWM increment. In various embodiments, the maximum PWM increment is less than 0.5% of the full-scale range, and preferably less than 0.3% of the full-scale range. For example, a 10-bit PWM generator divides the range into 1024 PWM increments. A one-bit increment is about 0.1% of full scale, a 3-bit increment is about 0.3% of full scale, and a 5-bit increment is about 0.5% of full scale. In one embodiment, the PWM increment is capped at (i.e., not permitted to exceed) a value that is not visually apparent or not substantially visually apparent to the human eye, thereby minimizing or substantially preventing steppiness or flicker of the light.

Figure 2:
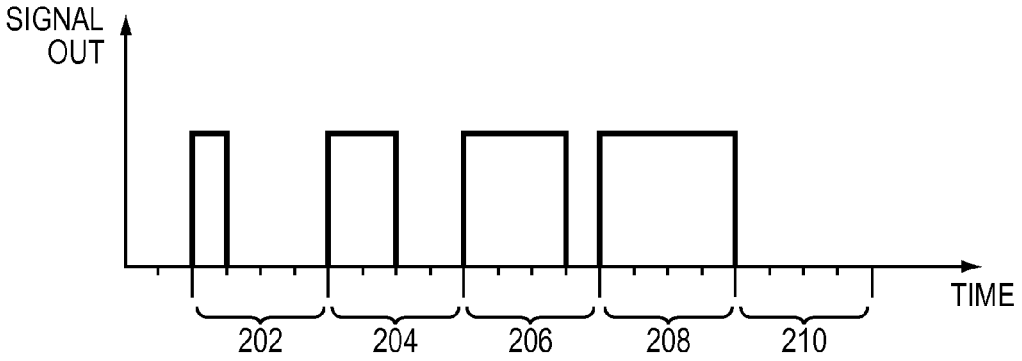
FIG. 2 is a timing diagram of a dimming signal in accordance with various embodiments of the invention.

The time response of the system to a full-scale control input change is given by (total # of bits/PWM increment)×PWM period. The PWM period is the reciprocal of the PWM frequency. For clarity, the PWM increment is the amount by which the duty cycle is changed, while the PWM frequency is the rate at which the duty cycle is updated. FIG. 2 shows a schematic for a system having a 2-bit PWM generator ($2^2$=4 bits). Five PWM periods 202, 204, 206, 208, and 210 are shown. In PWM period 202 the duty cycle is 1/4, in PWM period 204 the duty cycle is 2/4, in PWM period 206 the duty cycle is 3/4, in PWM period 208 the duty cycle is 4/4 or 1, and in PWM period 210 the signal is off (zero duty cycle). In this example, the time response of the system to a full-scale control input change is given by (4/1)×PWM period, i.e., 4 times the PWM period. If the PWM increment is changed to 2 bits, then the time response of the system to a full-scale control input change is given by (4/2)×PWM period, i.e., 2 times the PWM period. In various embodiments, the PWM period may range from about 0.5 ms to about 200 ms.

The change in control signal value is determined from the rolling average value. The rolling average takes $n_s$ samples at a sample period $\tau_s$. In the conventional approach, the rolling average will complete propagation of the new value in $n_s$ steps over $\tau_s \times n_s$ seconds, with each step having a value of (digital representation of the change increment)/$n_s$. For example, if the sample period is 25 ms and the number of samples in the rolling average is 16, it will take 25×16=400 ms for the light to complete changing intensity, assuming the PWM increment is sufficiently large. If this is a full-scale change in the value of the input dimming signal, then each rolling average delta will have a value of 1024/16=64 bits or 6.25% of full scale (using an example of a 10-bit PWM generator). As mentioned previously, responding to such a large delta by changing the duty cycle by a proportionally large PWM increment every sample period $\tau_s$ will result in an undesirably stepped dimming behavior. In various embodiments, the sample period may be in the range of about 5 ms to about 400 ms.

In various embodiments of the present invention, the PWM increments are adjusted by subdividing the change by the number of PWM periods per sample period. For example, for a PWM period of 1.25 ms (corresponding to a PWM frequency of 800 Hz) and sample period of 25 ms, the PWM duty cycle may be updated 20 times per sample period. The PWM increment to respond to a full-scale change in input dimming signal is 64/20=~3 bits or about 0.3% of full scale. This gives a full-scale response time of about (1024/3)×1.25 or about 425 ms.

In various embodiments, the PWM increment is reduced to 1 bit, to further increase the smoothness of the change in light intensity. However, in such embodiments this results in a full-scale response time of about 1024×1.25 or about 1.28 seconds, which may be relatively long.

In yet other embodiments of the present invention, the rolling average delta is used in a look-up table to determine the actual PWM increment to be used. In such embodiments, the actual PWM increment is adaptively varied to provide a smooth change in light intensity together with a suitably fast response time. In many embodiments, the actual PWM increment (i.e., that which is applied to the driver and/or light-emitting elements) is relatively smaller than the rolling average delta.

In various embodiments, the PWM increment determined by the rolling average delta is modified by a determination of the actual light (or power) output level of the lighting system. For example, the light (or power) output range may be divided into two or more ranges and the actual PWM increment set to a level below the PWM increment determined by the rolling average delta for light output levels below the top range, and equal to the PWM increment determined by the rolling average delta for light output level within the top range. In some embodiments, the light output range may be divided into two sub-ranges, while in other embodiments it may be divided into three or more ranges. In one embodiment, the light output range is divided into two ranges, with the boundary between the two ranges having a value in the range of about 2% to about 25% of the maximum light output power value, or in the range of about 4% to about 15% of the maximum light output power value.

In various embodiments of the present invention, a look-up table is used, for example as shown in Table 1, to determine the actual PWM increment based on the change in rolling average delta, which is directly related to the value of the change in the input control signal. Table 1 shows one example of a look-up table for a system having three levels of actual PWM increment. If the rolling average delta is greater than A, then the actual PWM increment is $S_1$. If the rolling average delta is less than A but greater than B, then the actual PWM increment is $S_2$. If the rolling average delta is less than B, then the actual PWM increment is $S_3$. Larger rolling average deltas result in larger actual PWM increments, and thus $S_1>S_2>S_3$. The time response to a change is given by (# bits/S)×PWM period.

TABLE 1

| If the rolling average delta: | Then actual PWM increment is: |
|---|---|
| # bits/$n_s$ > A | $S_1$ |
| B < # bits/$n_s$ < A | $S_2$ |
| # bits/$n_s$ < B | $S_3$ |

The values of A and B and $S_1$, $S_2$ and $S_3$ may be determined in a number of different ways. In various embodiments of the present invention, the largest actual PWM increment ($S_1$ in Table 1) is less than 0.5% or less than 0.3% of full scale, to avoid steppiness. In various embodiments, $S_2$ may be less than $S_1$ by one bit and $S_3$ may be less than $S_2$ by one bit. In other embodiments, these values may be determined differently. For example, in various embodiments, $S_2$ may be about one-half of $S_1$ and $S_3$ may be about one-half of $S_2$. In various embodiments, the value of A is determined by the input full-scale rolling average delta. In the example above this is 64 bits. In one example, B may be about one-half of A. In some embodiments, the actual values of $S_1$, $S_2$, and $S_3$, as well as A and B, may be determined experimentally without undue experimentation for a specific lighting system, thereby tailoring the values to achieve the desired response for that system without introducing steppiness or flicker. Table 1 shows three levels, but this is not a limitation of the present invention, and in other embodiments other numbers of levels may be used.

Table 2 shows values for various embodiments of the invention that include a 10-bit ADC and a PWM frequency of 800 Hz (PWM period is 1.25 ms) with rolling average values of $\tau_s$=25 ms and $n_s$=16, where the maximum actual PWM increment is 0.3%, corresponding to $S_1$=3 bits while $S_2$=2 bits and $S_3$=1 bit. The time response to a change is given by (# bits/S)×1.25 ms. The time response to a full-scale change is given by (1024/3)×1.25 ms or about 426 ms. In some embodiments, it is desirable for the change in light level, in response to an input control signal change, to be complete between about 25 ms and about 1000 ms, and more preferably between about 100 ms and about 700 ms.

TABLE 2

| If the rolling average delta: | Then actual PWM increment is: |
|---|---|
| # bits/16 > 40 | 3 |
| 20 < # bits/16 < 41 | 2 |
| # bits/16 < 21 | 1 |

Figure 3:
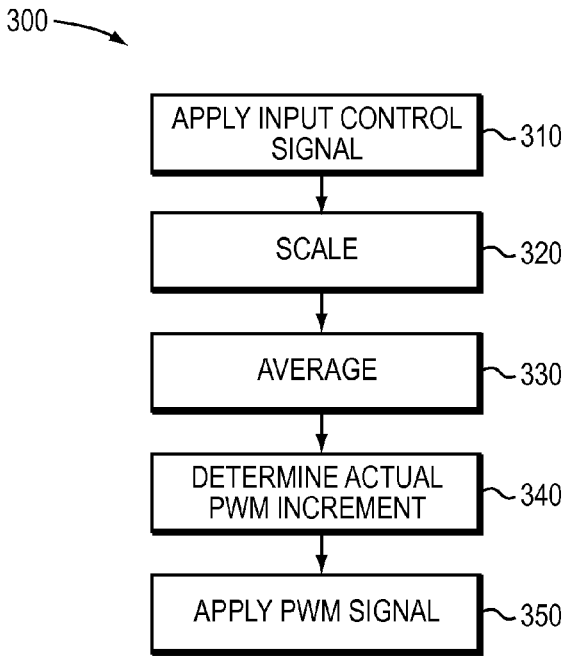
FIG. 3 is a flow chart of a dimming process in accordance with various embodiments of the invention.

FIG. 3 is a flow chart of an exemplary process 300 in accordance with various embodiments of the invention. Process 300 is shown having five steps; however, this is not a limitation of the present invention, and in other embodiments the invention has more or fewer steps and/or the steps may be performed in different order. In step 310 of process 300 an input control signal is provided. In step 320 the control signal is optionally scaled, for example to match the input requirements of the ADC. The PWM generator typically has a resolution of n bits, resulting in $2^n$ discrete values of duty cycle. In the case of a 10-bit PWM generator, this is 1024 different duty cycle values. The minimum step level is given by (full scale value of input signal)/($2^n$−1), or 100%/1023≈0.1%.

In step 330, the ADC output is averaged to smooth out the dimming behavior, help improve immunity to noise spikes on the ADC input signal, and slow down the response to avoid presenting step changes in the load to the power supply unit (PSU). In various embodiments, a rolling average is used, with $n_s$ samples and sample period $\tau_s$. In the conventional approach the rolling average will typically complete propagation of the new value in $n_s$ steps over $\tau_s \times n_s$ seconds, with each step having a value of (digital representation of the change increment)/$n_s$. For example, if the sample period is 25 ms and the number of samples in the rolling average is 16 it will take 25×16=400 ms for the light to complete changing intensity. If this is a full-scale change in the value of the input dimming signal, then each PWM increment will have a value of 1024/16=64 bits or 6.25% of full scale. As mentioned previously, such a large PWM increment will typically result in an undesirably stepped dimming behavior.

In various embodiments of the present invention, the steppiness is reduced or eliminated (i.e., the transition in light intensity is substantially smoothed) while maintaining desirable response times by two techniques. First, the PWM increment is adaptively changed based on the relative size of the control signal change. Second, the maximum PWM increment is limited to a value that is visually acceptable, so as to not produce visual steppiness when the light intensity is changed. The adaptive change in the PWM increment permits appropriate response times over a wide range of changes in the input control value. For example, if the change in the input control signal is relatively large, then the PWM increment is relatively large, while if the change in the input control signal is relatively small, then the PWM increment is relatively smaller.

As discussed previously, the rolling average delta is calculated in the averaging step 330. In step 340 the rolling average delta is used to determine the actual PWM increment. In various embodiments, the PWM increment is determined using a look-up table, for example similar to that shown in Table 2. In various embodiments, the PWM increment is determined by calculation. For example, in various embodiments, the PWM increment may be calculated according to the following formula:

PWM increment=Rolling Average Delta/(Sample Period/PWM Period)

For example, in one embodiment where the Sample Period=25 ms and the PWM Period=1.25 ms, the above formula will result in PWM increment=Rolling Average Delta/20. Thus, for a 10-bit ADC and a 16-sample rolling average, the maximum Rolling Average Delta would be 1024/16=64, which would result in a PWM Increment of 3.2 bits. Rounding up to the nearest whole bit results in a PWM increment of 4. In a digital system, since only integer values of duty cycle may generally be applied, it is generally necessary to round to the nearest whole bit value. By rounding up this ensures that if 0>Rolling Average Delta>(Sample Period/PWM Period), a PWM increment of 1 will still be applied to be able to reach the exact set point desired. For example, for the same embodiment, if the Rolling Average Delta=15, the calculated PWM increment would be 0.75, but the actual PWM increment of 1 bit would be applied each PWM period, but only for a number of periods equal to the Rolling Average Delta, so as to prevent over/undershoot.

In step 350 the actual PWM increment is applied to the driver system to effect the change in light intensity. The PWM frequency and the actual PWM increment determine the time response for completing the light intensity change.

Figure 4:
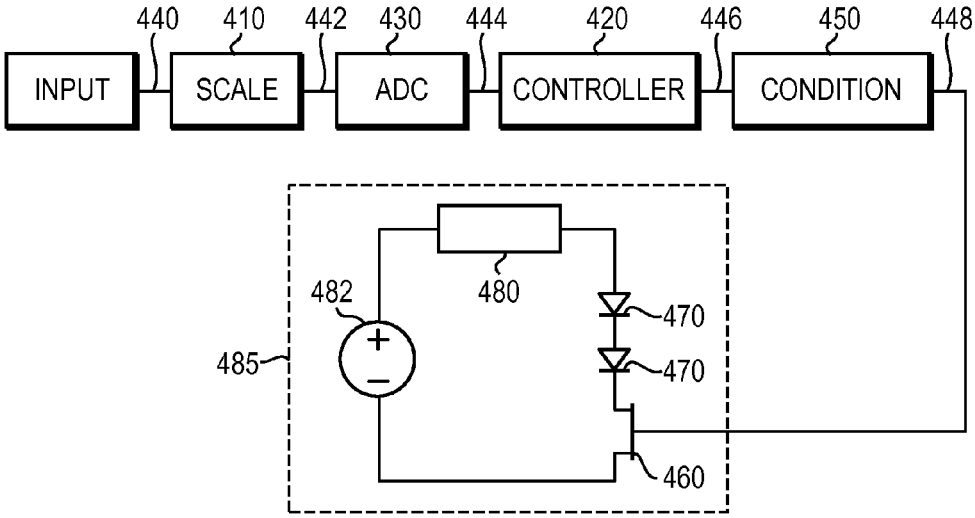
FIG. 4 is a block diagram of a dimming system in accordance with various embodiments of the invention.

FIG. 4 shows a schematic block diagram of a dimming circuit 400 in accordance with various embodiments of the present invention. An input control signal 440 is provided to the dimming circuit, for example from a stand-alone dimmer (e.g., a dimming switch), a building management control system, a sensor, or the like. The source of input signal 440 is not a limitation of the present invention. An optional input conditioning element 410 may be included to modify input signal 440 to signal 442, for example to match the input range of an analog-to-digital converter (ADC) 430. For example, input conditioning element 410 may convert a 0-10 V signal 440 to a signal 442 having a range of 0-2.5 V to match the input requirements of ADC 430. While in this example conditioning element 410 is described to condition the 0-10 V input to a 0-2.5 V output, this is not a limitation of the present invention, and in other embodiments other scaling algorithms may be used. Scaling algorithms may be linear, exponential, or logarithmic, or they may have any desired relationship between the input and output.

ADC 430 converts the optionally scaled input signal 442 (which, in the absence of scaling, corresponds to input signal 440) to a digital representation 444, where the value of the digital representation 444 is proportional to optionally scaled input signal 442. Controller 420 takes the output of ADC 430 (digital representation 444), performs the adaptive scaling discussed herein, and converts it to a PWM signal 446, where the duty cycle of the PWM signal 446 is proportional to the value of input signal 440. PWM signal 446 may then be optionally conditioned by a conditioning element 450, to adjust or modify PWM signal 446 to PWM signal 448, to match the input requirements of the driver to which the signal is applied. In various embodiments, PWM signal 448 is used to drive a field-effect transistor (FET) 460 in series with light-emitting elements 470 and optional current control element 480. Circuit 485 in FIG. 4 includes light-emitting elements 470 in series with FET 460 and optional current control element 480 with power supplied by a power supply 482. Circuit 485 is meant to be illustrative; the present invention is not limited by the specific implementation of the driver and light-emitting elements. In some embodiments, light-emitting elements 470 may include or consist essentially of light-emitting diodes. While FIG. 4 shows two light-emitting elements 470, this is not a limitation of the present invention, and in other embodiments any number of light-emitting elements may be used. Optional current control element 480 may be included to aid in controlling the current to light-emitting elements 470, for example to provide a constant current or substantially constant current to light-emitting elements 470. In various embodiments, current control element 480 may include or consist essentially of a resistor. In various embodiments, current control element 480 may include one or more active devices, for example one or more transistors, and one or more passive devices, for example one or more resistors. In various embodiments, current control element 480 may include or consist essentially of an integrated circuit.

In FIG. 4, ADC 430 is shown separately from controller 420; however, this is not a limitation of the present invention, and in other embodiments ADC 430 may be part of controller 420. In some embodiments, it is advantageous from a cost perspective to use a microcontroller that includes the ADC. Furthermore, aspects of the present invention are particularly suitable for relatively low-cost microcontrollers having an embedded ADC, where the resolution of the ADC is relatively low and/or the speed and resolution of the PWM generator is relatively low.

In some embodiments, the averaging (shown in step 330 of FIG. 3) may be performed in ADC 430, while in other embodiments it may be performed in controller 420. In some embodiments, the averaging function may be shared between ADC 430 and controller 420. The specific location where averaging is performed is not a limitation of the present invention.

In various embodiments, the dimming signal may be an analog signal (for example a continuous signal such as a 0-10V signal), and the dimming information may be conveyed by the phase of the dimming signal, or in a phase-cut dimming signal, or the like, while in other embodiments the dimming signal may be a digital signal. In various embodiments, the digital signal may have different forms or configurations, for example, the information may be conveyed by a pulse-width modulated signal or in a series of digital words made up of one or more bits of information representing the dimming level, or encoded using various standards, for example DALI, DMX, Zigbee Light Link, or the like. The specific form of the dimming signal is not a limitation of the present invention.

Figure 5A:
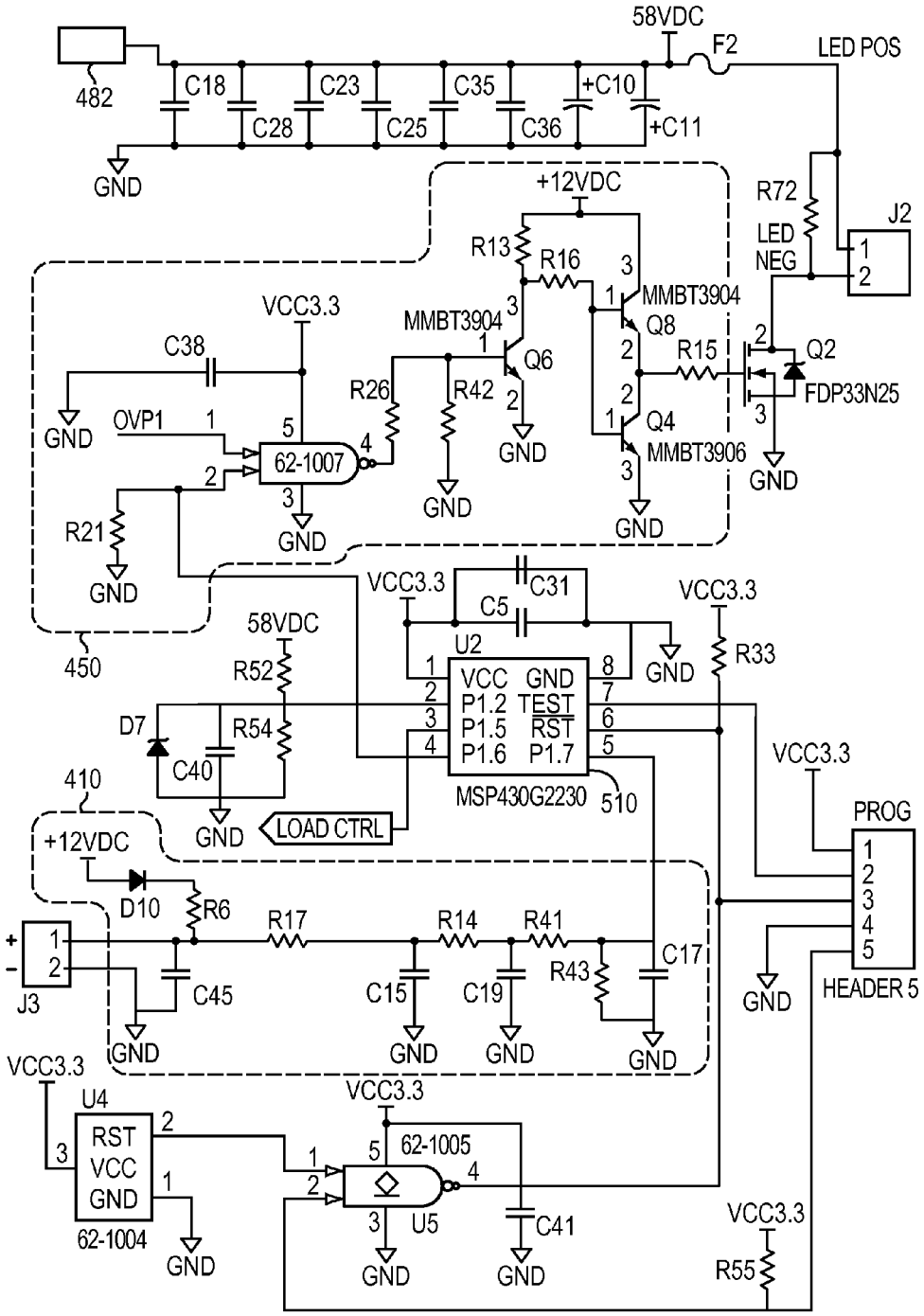
FIGS. 5A, 5B, and 5C are portions of an electrical schematic of a dimming system in accordance with various embodiments of the invention.
Figure 5B:
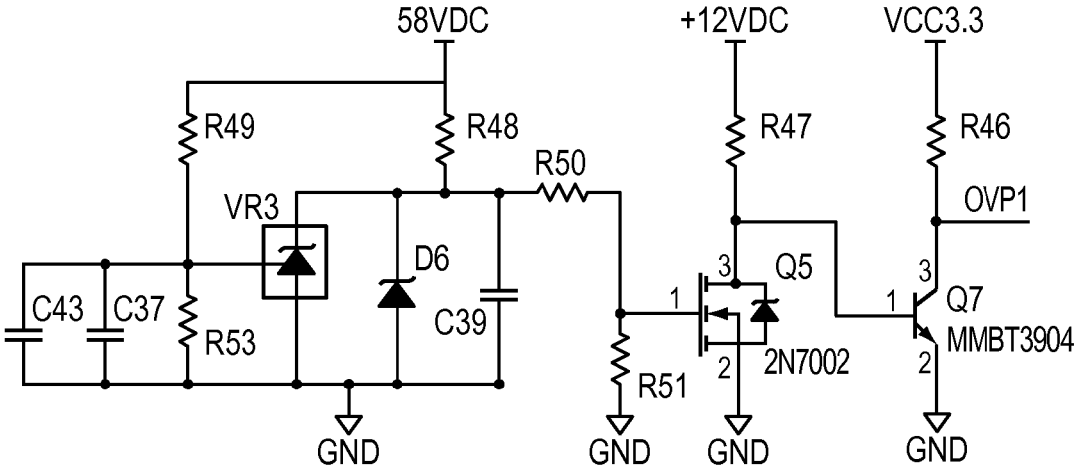
Figure 5C:
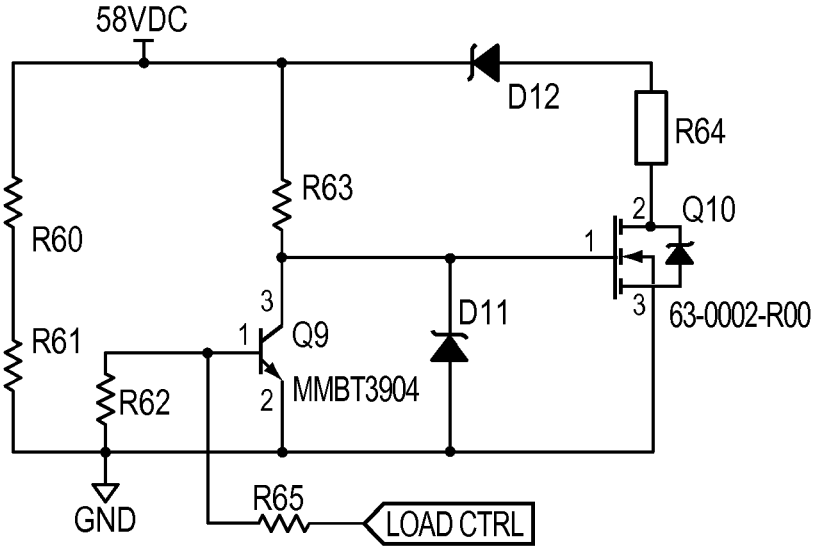

FIGS. 5A-5C show portions of a circuit schematic of various embodiments of the present invention. Power is supplied to the light-emitting elements through J2. The input control signal 0-10 V is applied to J3. Circuit components that perform the scale function, identified as 410 in FIG. 4, and the condition function, identified as 450 in FIG. 4, are identified with the same identifier in FIG. 5A. Controller 510 includes controller 420 and ADC 430 from FIG. 4.

In the depicted embodiment, the driver is designed to interface to 0-10V dimmers that comply with the International Electrotechnical Commission (IEC) 60929 Annex E standard, the entire disclosure of which is incorporated by reference herein. Internal circuitry will filter and scale the 0-10V analog dimming signal to nominally 0-2.5V to match the internal 2.5V reference of the microcontroller's ADC input (P1.7). The PWM output (P1.6) is ANDed with the OVP1 signal, inverted twice and level shifted to drive the gate of the driver output metal-oxide-semiconductor field-effect transistor (MOSFET) Q2 with positive logic.

In this embodiment, a hardware over-voltage protection (OVP) circuit (FIG. 5B) monitors the positive output of the driver via resistor divider R49 and R53 in conjunction with programmable Zener diode VR3. If the divided voltage input to VR3 goes above a certain threshold, VR3 is activated, which pulls the voltage signal at the gate of Q5 low, turning it off, which turns on Q7 and causes OVP1 signal to go low, ultimately causing the output of the driver to turn off. If the divided voltage sensed by VR3 is below a certain threshold, the signal at the gate of Q5 stays high, which turns Q7 off, which keeps the OVP1 signal high, and the driver output is enabled.

As a backup to the hardware OVP circuit, the positive output of the driver (LED POS) is sensed using a second ADC input (P1.2) on the controller 510. If the signal at P1.2 exceeds a certain threshold, the controller 510 will disable the driver output using the same output (P1.6) as is used for dimming.

In the depicted embodiment, the start-up load shown in FIG. 5C (D12+R64) of approximately 4 W is turned on by the controller 510 when it comes out of reset at power-up by turning Q9 off, which turns on Q10. The load is disabled after a fixed time period of about 4 seconds unless the voltage sensed at P1.2 is below a certain threshold. In various embodiments, a low-level threshold of about 50V and a high-level threshold of about 60V are utilized to ensure that the power supply is producing sufficient voltage to drive the light-emitting elements, at which point they provide a sufficient load to allow the power supply to regulate properly. If the output load is removed, for example when the light-emitting elements are shut off completely by using the dimmer, then the power supply output voltage may go out of regulation and the output voltage may drift outside the upper or lower thresholds mentioned above, at which point the controller 510 will reactivate the start-up load.

In this embodiment, the PROG header is simply a set of test pads on the board which allows in-circuit programming of the controller 510 (either for initial programming or firmware updates, for example). The open-drain NAND gate enables this by disabling the reset circuit (active HI) and leaving PROG pin 3 high impedance for programming since PROG pin 5 is pulled low to program. The truth table for the logic is shown in Table 3.

TABLE 3

| Reset Output | NAND Input (pin 2) | NAND Output |
|---|---|---|
| Low | Low | High-impedance |
| Low | High | High-impedance |
| High (reset) | Low | High-impedance |
| High (reset) | High | Low |

Figure 6:
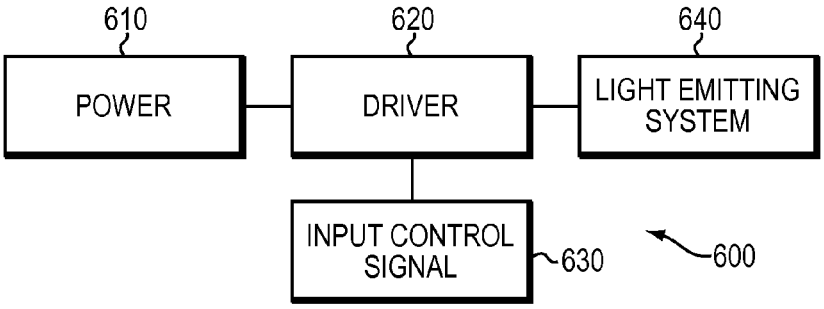
FIG. 6 is a block diagram of a lighting system in accordance with various embodiments of the invention.

FIG. 6 shows an exemplary lighting system using the dimming control in accordance with various embodiments of the present invention. System 600 includes a source of power 610, a driver 620 that includes the dimming control system, an input control signal 630 providing the dimming signal to driver 620, and a light-emitting system 640. In one embodiment, driver 620 may include all of the elements shown in FIG. 4, excluding those associated with element 485. In another embodiment, FET 460 may be part of driver 620. In one embodiment, FET 460 and current control element 480 may be part of driver 620.

Figure 7:
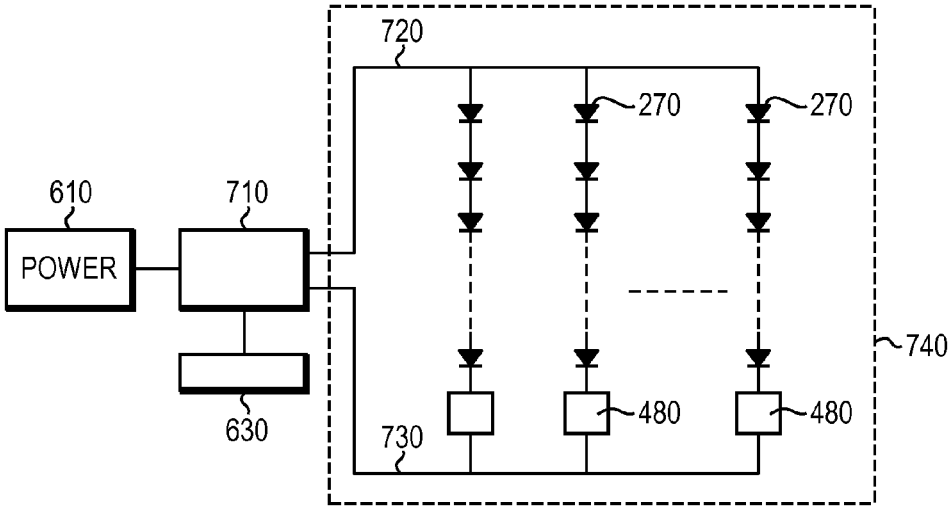
FIGS. 7 and 8 are schematic illustrations of lighting systems in accordance with various embodiments of the invention.

FIG. 7 shows an exemplary lighting system using the dimming control in accordance with various embodiments of the present invention. In this embodiment, light-emitting system 640 of FIG. 6 includes multiple light-emitting strings, and each light-emitting string includes multiple series-connected light-emitting elements 270 and a current control element 480. In this embodiment, driver 710 provides a constant voltage or substantially constant voltage to power lines 720 and 730, which provide power to the light emitting strings. Additional details of this and similar lighting systems may be found in U.S. patent application Ser. No. 13/799,807, filed Mar. 13, 2013, and U.S. patent application Ser. No. 13/970,027, filed Aug. 19, 2013, the entire disclosure of each of which is incorporated by reference herein.

Figure 8:
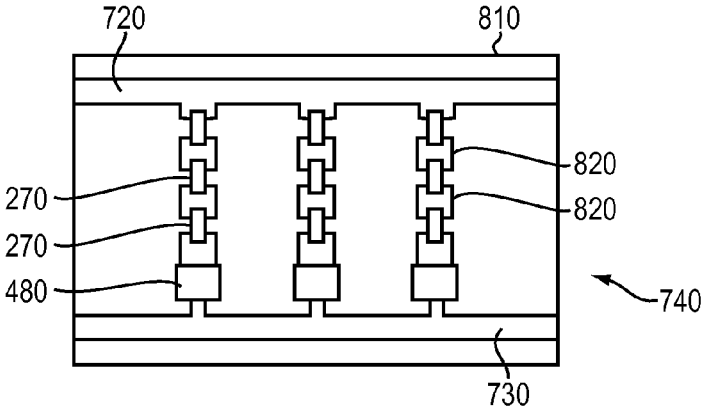

In some embodiments, light-emitting system 740 may be a light sheet that includes a substrate, which may be a flexible substrate, conductive traces disposed over the substrate that interconnect and provide power to light-emitting elements 270 and current control elements 480, and light-emitting elements 270 and current control elements 480. FIG. 8 shows a schematic of a light sheet 740. Light sheet 740 includes a substrate 810 over which are disposed power conductors 720, 730 and conductive elements 820 interconnecting light-emitting elements 270 and current control elements 480. In various embodiments, substrate 810 may be substantially planar.

In some embodiments, the substrate may include or consist essentially of a semicrystalline or amorphous material, e.g., polyethylene naphthalate (PEN), polyethylene terephthalate (PET), polycarbonate, polyethersulfone, polyester, polyimide, polyethylene, fiberglass, FR4, metal core printed circuit board, (MCPCB), and/or paper. The substrate may include multiple layers, e.g., a deformable layer over a rigid layer, for example, a semicrystalline or amorphous material, e.g., PEN, PET, polycarbonate, polyethersulfone, polyester, polyimide, polyethylene, and/or paper formed over a rigid substrate for example comprising, acrylic, aluminum, steel and the like. Depending upon the desired application for which embodiments of the invention are utilized, the substrate may be substantially optically transparent, translucent, or opaque. For example, the substrate 810 may exhibit a transmittance or a reflectivity greater than 70% for optical wavelengths ranging between approximately 400 nm and approximately 700 nm. In some embodiments the substrate may exhibit a transmittance or a reflectivity of greater than 70% for one or more wavelengths emitted by light-emitting elements 270. The substrate may also be substantially insulating, and may have an electrical resistivity greater than approximately 100 ohm-cm, greater than approximately $1\times10^6$ ohm-cm, or even greater than approximately $1\times10^{10}$ ohm-cm.

Conductive traces may be formed via conventional deposition, photolithography, and etching processes, plating processes, lamination, lamination and patterning, evaporation sputtering or the like or may be formed using a variety of different printing processes. Conductive traces may include or consist essentially of a conductive material (e.g., an ink or a metal, metal film or other conductive materials or the like), which may include one or more elements such as silver, gold, aluminum, chromium, copper, and/or carbon. Conductive traces may have a thickness in the range of about 50 nm to about 1000 μm. In some embodiments, a layer of material, for example insulating material, may be formed over all or a portion of the conductive traces. Such a material may include, e.g., a sheet of material such as used for the substrate, a printed layer, for example using screen, ink jet, stencil or other printing means, a laminated layer, or the like. Such a printed layer may include, for example, an ink, a plastic and oxide, or the like. The covering material and/or the method by which it is applied is not a limitation of the present invention.

In various embodiments of the present invention, the actual PWM increment is varied during the light intensity change period to provide additional smoothing of the change in light intensity. In such embodiments, relatively smaller actual PWM increments are used at relatively low light intensity levels, where relatively small changes in light intensity are more readily apparent, and relatively larger actual PWM increments are used at relatively high light intensity levels, where relatively larger changes in light intensity are not as visible.

Figure 9:
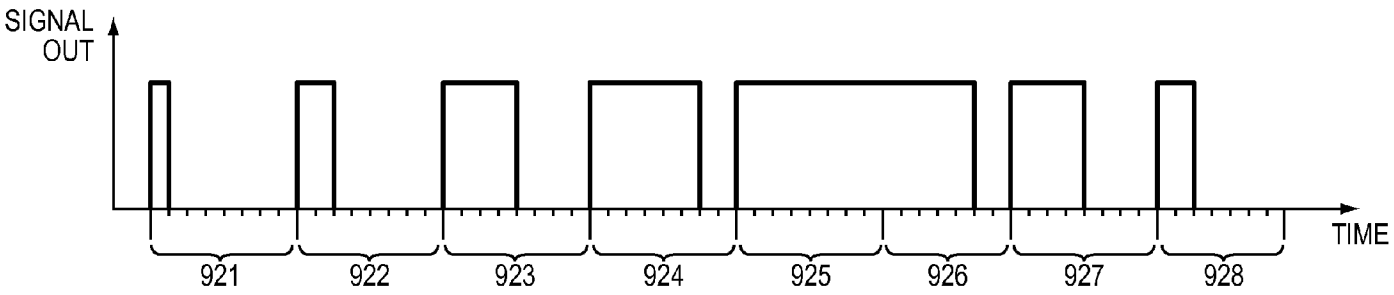
FIG. 9 is a timing diagram of a dimming signal in accordance with various embodiments of the invention.

FIG. 9 shows a schematic of the PWM signal as a function of time for a system having a 3-bit PWM generator ($2^3$=8 bits) in accordance with various embodiments of the present invention. Eight PWM periods 921, 922, 923, 924, 925, 926, 927, and 928 are depicted. In PWM period 921 the light is just turning on (low light intensity), so the PWM increment is small—one bit resulting in a duty cycle of 1/8. In PWM period 922 the light level is still relatively low, so the PWM increment is one bit and the duty cycle increases to 2/8. In PWM periods 923-925 the light level is relatively higher and the PWM increment increases to 2 bits resulting in a duty cycle of 4/8, 6/8 and 8/8 for PWM periods 923, 924, and 925 respectively. As the light level decreases, the PWM increment is 2 bits at high light intensities (PWM periods 926, 927, and 928). As the light level decreases further the PWM increment decreases to 1 bit (not shown) at relatively low light levels. The schematic shown in FIG. 9 is exemplary; in some embodiments, the PWM generator may have higher resolution, for example 8 bits, 10 bits, 12 bits, or the like. The PWM increment in the example in FIG. 9 changes from one bit to two bits; however, this is not a limitation of the present invention, and other embodiments may use other PWM increments and may have more than two PWM increment levels.

Figure 10:
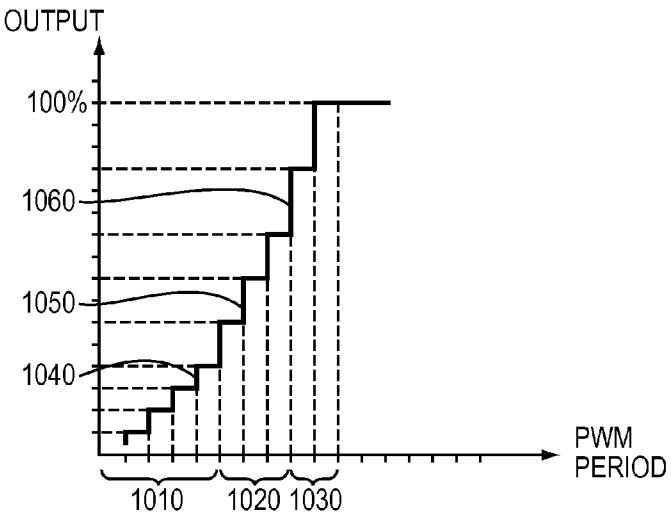
FIG. 10 is a schematic illustration of a dimming signal in accordance with various embodiments of the invention.

FIG. 10 shows a graph of light intensity as a function of PWM period for an increase in light intensity from zero to 100% in accordance with various embodiments of the present invention. During the PWM periods 1010, the PWM increment 1040 has value $T_1$, during the PWM periods 1020, the PWM increment 1050 has value $T_2$, and during the PWM periods 1030, the PWM increment 1060 has value $T_3$. In the depicted embodiment, $T_3>T_2>T_1$ so that the light level change is relatively smaller at low light intensities and relatively larger at high light intensities. While the example shown in FIG. 10 utilizes three levels, this is not a limitation of the present invention, and in other embodiments other number of levels may be utilized.

In various embodiments of the present invention, a look-up table is used, for example as shown in Table 4, to determine the actual PWM increment based on the light intensity level, which itself may be determined by several techniques. In various embodiments, the light intensity level is determined from the value of the input control signal. In various embodiments, the light intensity level is determined from the value of the average or rolling average of the input signal. Table 4 shows one example of a look-up table for a system having three levels of actual PWM increment. If the light intensity level is less than A (corresponding to region 1010 in FIG. 10), then the actual PWM increment is $T_1$. If the light intensity level is less than B and greater than A (corresponding to region 1020 in FIG. 10), then the actual PWM increment is $T_2$. If the light intensity level is greater than B (corresponding to region 1030 in FIG. 10), then the actual PWM increment is $T_3$.

TABLE 4

| If: | Then actual PWM increment is: |
|---|---|
| Light Intensity Level < A | $T_1$ |
| B > Light Intensity Level > A | $T_2$ |
| Light Intensity Level > B | $T_3$ |

The values of A and B and $T_1$, $T_2$ and $T_3$ may be determined in a number of different ways. In various embodiments, the smallest actual PWM increment may be the minimum PWM increment available with the hardware of the system, for example the least significant bit. In various embodiments, the different levels may be separated by one step, for example in one embodiment $T_1$ is one step, $T_2$ is two steps and $T_3$ is three steps. Here a step is defined as the minimum resolution step available in the PWM generator. For example, in a 10-bit PWM generator, the minimum step is 100%/1024 or about 0.1%. Thus, in various embodiments, $T_1$ is 0.1%, $T_2$ is 0.2%, and $T_3$ is 0.3% of full scale. In various embodiments, $T_1$ is one step, $T_2$ is two steps, and $T_3$ is four steps, in other words $T_1$ is 0.1% step, $T_2$ is 0.2% and $T_3$ is 0.4% of full scale. While this example uses three levels, this is not a limitation of the present invention, and in other embodiments any number of levels may be used. In some embodiments, the number of levels and values for each step may be determined empirically, by varying these parameters and evaluating the smoothness and speed of the change in intensity of the light source, and optimizing the parameters based on empirical observations and without undue experimentation.

In various embodiments of the present invention, three levels may be used and $T_1$ is in the range of about 0.05% to 0.5% of full scale, $T_2$ is in the range of about 0.25% to 1% of full scale, and $T_3$ is in the range of about 0.75% to about 5% of full scale. In various embodiments of the present invention, two levels may be used and $T_1$ is in the range of about 0.1% to 1.0% of full scale and $T_2$ is in the range of about 0.75% to 5% of full scale. In various embodiments of the present invention, four levels may be used and $T_1$ is in the range of about 0.05% to 0.5% of full scale, $T_2$ is in the range of about 0.25% to 1% of full scale, $T_3$ is in the range of about 0.75% to about 2% of full scale, and $T_4$ is in the range of about 1.75% to about 5% of full scale.

In various embodiments of the present invention, three levels may be used and $T_1$ is in the range of about 0.01% to 0.1% of full scale, $T_2$ is in the range of about 0.05% to 0.5% of full scale, and $T_3$ is in the range of about 0.25% to about 2.5% of full scale. In various embodiments of the present invention, two levels may be used and $T_1$ is in the range of about 0.01% to 0.5% of full scale and $T_2$ is in the range of about 0.25% to 2.5% of full scale. In various embodiments of the present invention, four levels may be used and $T_1$ is in the range of about 0.01% to 0.05% of full scale, $T_2$ is in the range of about 0.025% to 0.1% of full scale, $T_3$ is in the range of about 0.05% to about 0.5% of full scale, and $T_4$ is in the range of about 0.25% to about 2.5% of full scale.

Referring to Table 4 above and the previous embodiments describing the ranges of actual PWM increments that may be used, the light intensity level thresholds A and B may in various embodiments be set such that A is in the range of about 0.1% to about 10% of full scale and B is in the range of about 5% to about 25%. In another embodiment, A may be in the range of about 0.1% to about 5% and B may be in the range of about 1% to about 10%. In some embodiments of the present invention, A may be about 2% and B may be about 5%. In another embodiment where there are 4 levels, utilizing three thresholds A, B and C, A may be in the range of about 0.05% to about 1%, B may be in the range of about 0.1% to about 2.5%, and C may be in the range of about 0.5% to about 25%.

While the example above uses a number of levels with each level assigned a value in a look-up table arrangement, other methods may be used to determine the level value. For example, an equation or mathematical relationship may be used to determine the actual PWM increment from the current light level.

Figure 11:
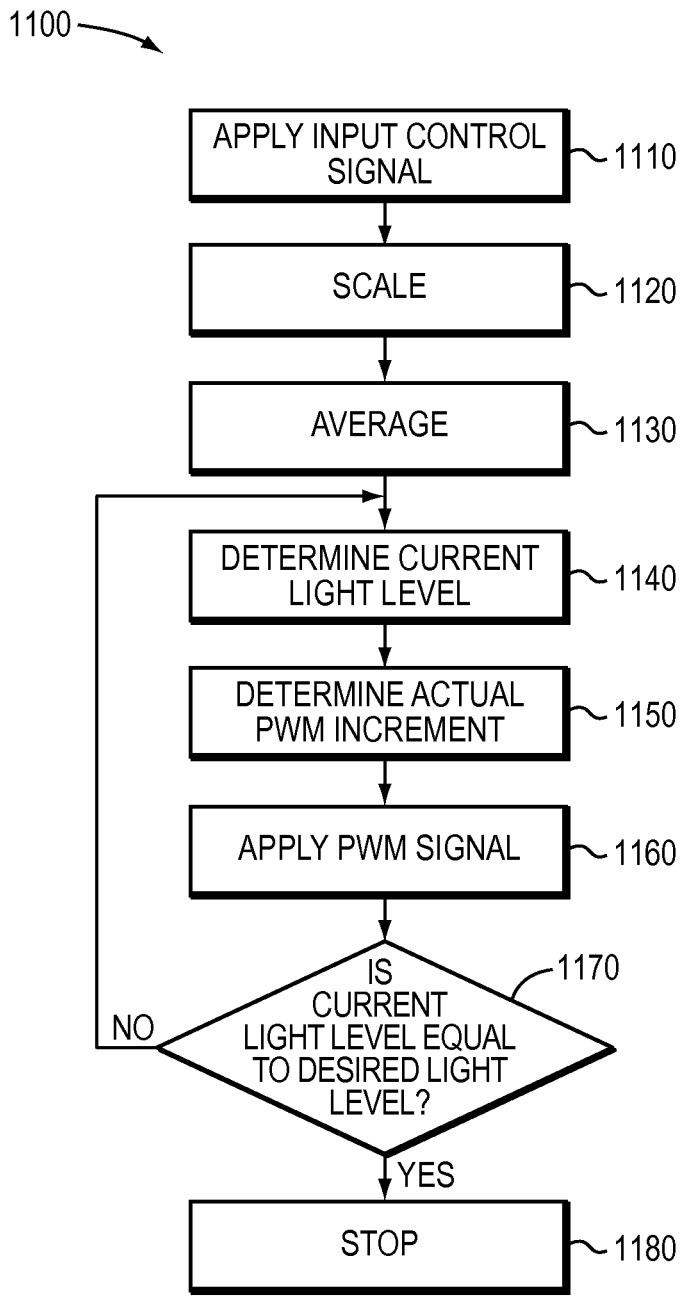
FIG. 11 is a flow chart of a dimming process in accordance with various embodiments of the invention.

FIG. 11 is a flow chart of one embodiment of the present invention. In step 1110 of process 1100, a control signal is provided. In step 1120, the control signal is optionally scaled, for example to match the input requirements of the ADC. In step 1130, the ADC output is averaged to smooth out the dimming behavior, help improve immunity to noise spikes on the ADC input signal, and slow down the response to avoid presenting step changes in the load to the power supply unit (PSU). In step 1140, the current light level is determined. In step 1150, the current light level is used to determine the actual PWM increment, as described herein. In step 1160, this actual PWM increment is used to apply the PWM signal to the lighting system. In step 1170, the system determines if the desired light level has been reached. If so, the process stops (step 1180). If not, the process loops back to step 1140 where the current light level is again determined and the process repeats. In this way, for relatively low light levels, relatively small actual PWM increments are used, while for relatively high light levels, relatively larger actual PWM increments are used, resulting in a visually smoother light transition.

In various embodiments of the present invention, the actual light intensity level is not determined directly, but instead is inferred or determined from the dimmer input that defines a target output duty cycle that is representative of the light level. In various other embodiments of the present invention, the light level is determined directly, for example by a sensor or a measurement of the input power to the light-emitting element(s).

In the example described above, the number of levels is fixed and the actual PWM increment varies according to the actual light level. In other embodiments, the number of levels may vary while the actual PWM increment is fixed, or both the number of levels and the PWM increment may both vary.

In some embodiments of the present invention, a signal is provided to initiate the dimming step, but the signal does not convey a specific dimming level; instead the signal tells the system to start changing the light level until the system is instructed to stop changing the light level. In some embodiments of the present invention, the signal may be initiated by a user, for example by actuating a momentary contact switch that directs the system to change the light level as long as the momentary contact switch is actuated. When the momentary contact switch is de-actuated, for example when the user determines that the light level has reached a desirable level, the ramping of the light level is terminated.

While the description of the operation above includes a user initiating and terminating the dimming signal (as discussed herein, dimming may include both a decrease or an increase in light level), this is not a limitation of the present invention, and in other embodiments dimming may be initiated and/or terminated by other means, for example by a timer, motion sensor, proximity sensor, occupancy sensor, programmable controller, building automation system, security system, smoke or fire detection system, or the like. In some embodiments of the present invention, the level of light intensity may be determined visually by a user; however this is not a limitation of the present invention, and in other embodiments the light intensity level may be determined by a sensor, for example a photosensor or other light sensor. In some embodiments of the present invention, a signal from a light sensor, or a signal initiated by a light sensor but processed or modified by another system or a signal from another system (for example a timer, motion sensor, proximity sensor, occupancy sensor, programmable controller, building automation system, security system, smoke or fire detection system, or the like) may be used to terminate dimming.

Figure 12:
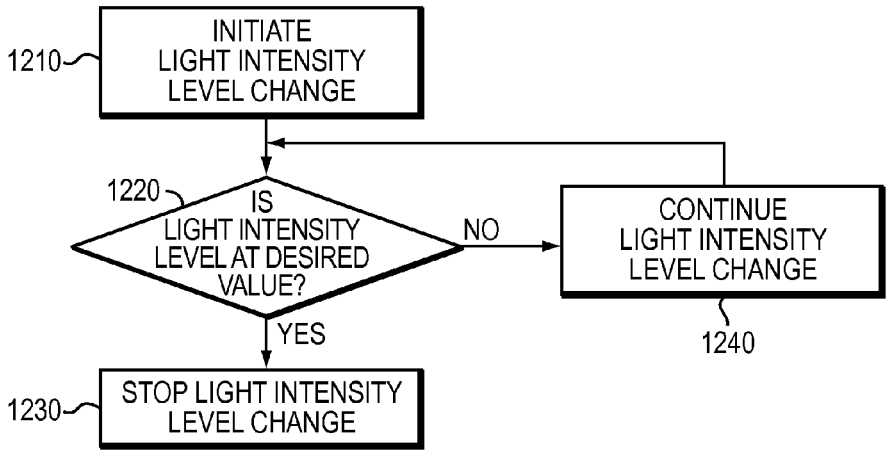
FIG. 12 is a flow chart of a dimming process in accordance with various embodiments of the invention.

FIG. 12 depicts a flow chart of an exemplary process in accordance with various embodiments of the invention. The depicted process is shown having four steps; however, this is not a limitation of the present invention, and in other embodiments the invention has more or fewer steps and/or the steps may be performed in different order. In step 1210, the dimming process, also known as the light intensity level change, is initiated. In step 1220, the value of the light intensity level is evaluated after a certain amount of time has passed during which the light intensity level has changed. If the light intensity level is at a desired value, the process moves to step 1230, in which the light intensity level change is halted (to stop the dimming process). If the light intensity level is not at a desired value, the process moves to step 1240, in which the light intensity level change is continued (to continue dimming), and the process is repeated until the desired light intensity level is reached. In some embodiments of the present invention, the light intensity may increase when a light intensity level change is initiated, while in other embodiments the light intensity may decrease when a light intensity level change is initiated. In some embodiments of the present invention, when the light intensity reaches a maximum or minimum, the system may stop changing the light intensity and leave the light intensity at the maximum or minimum value. In some embodiments, the system may set the light intensity to zero (for example by removing power from the illumination source) when the system reaches the minimum light output value. In some embodiments of the present invention, the system may cycle to the opposite value upon reaching the maximum or minimum light output value. For example, in some embodiments of the present invention, when the light level reaches a minimum value, if the light level change signal has not been de-activated, the light level may switch to the maximum value and then start decreasing from that value. In another example, when the light level reaches a maximum value, if the light level change signal has not been de-activated, the light level may switch to the minimum value and then start increasing from that value. In another embodiment, when the light level is increasing and reaches a maximum value, if the light level change signal has not been de-activated, the light level change direction may reverse to begin decreasing from the maximum value. Likewise, when the light level is decreasing and reaches a minimum value the light level change direction may reverse to begin increasing from a minimum value. The specific cycle of how the system reacts upon reaching a maximum or minimum light output value is not a limitation of the present invention.

FIG. 13 depicts an LED control circuit that provides power and dimming functions to an externally connected set of light-emitting elements (e.g., LEDs, not shown) using a dimming actuation signal in accordance with various embodiments of the present invention. The control circuit includes a voltage boost stage 1320 that accepts an input voltage in the range of 12-48 VDC and boosts it to approximately 58 VDC at the output, and a control input 1310 that is a momentary contact tact switch or button 1315 connected to debounce circuitry featuring resistors, a capacitor, and a Schmitt trigger to ensure the switching signal applied to microcontroller 1330 is a stable digital signal of a known value, for example either 0V or 3.3V with no intermediate level. The remaining portions of the circuit have been previously identified and described in FIGS. 5A and 5B. In this embodiment, the control input 1315 operated by a user provides different functions. For example, a short press and release of the switch signals the microcontroller to toggle the state of the light-emitting elements from Off to On or On to Off. Pressing and holding the switch closed for more than a specified time period, for example 1 second, signals the microcontroller to enter a dimming mode in which it automatically dims the light-emitting element output by changing the PWM duty cycle from 100% down to 1% over a set time period, for example 3 seconds. Releasing the switch and then repeating the press-and-hold action may signal the microcontroller to reverse the dimming direction and increase the light output by changing the PWM duty cycle from 1% up to 100%. During this ramp down and ramp up function, in some embodiments the PWM increment may be of a fixed value, for example 4 bits for the entire ramping period. In another embodiment of the present invention, the PWM increment may automatically change based on the actual duty cycle or light level. For example, when the duty cycle is below about 2%, the PWM increment may be 1 bit, and when the duty cycle is between about 2% and about 5%, the PWM increment may be 2 bits, and when the duty cycle is above about 5%, the PWM increment may be 4 bits. Other embodiments may have different thresholds and different PWM increments applied between the different threshold levels.

In some embodiments of the present invention, the dimming mode may be implemented differently so that after the user presses and holds the button for some time period, for example 1 second, the user would then need to press and release the button repeatedly to set different predetermined levels. For example, the first press and release would dim the output down from 100% duty cycle to 75% duty cycle. Each subsequent press and release would cause another step down by 25% until it reaches 25%, and then it would automatically cycle back up to 100% and the process may be repeated. Pressing and holding (for a time period such as 1 second) may exit this dimming mode, and the LED dim setting may stay at the last setting reached. In other embodiments of the present invention, more steps with smaller step sizes may be implemented, for example 5 steps of 20%.

In some embodiments of the present invention, both the ramp dimming and the step dimming modes described above may be implemented, and the user may access each of the different dimming modes by different sequences of button presses or different press-and-hold time periods.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A method for controlling changes in light intensity in an illumination system that emits light in response to an output drive signal, the method comprising:

(A) receiving a signal to initiate dimming;

(B) determining a present value of the output drive signal;

(C) computing a change increment for the output drive signal based on the present value of the output drive signal, wherein the change increment is (i) a first value if the present value of the output drive signal is less than a threshold and (ii) a second value greater than the first value if the present value of the output drive signal is greater than the threshold; and (D) changing the output drive signal by the change increment.

2. The method of claim 1, further comprising capping the first value or the second value at a maximum value.

3. The method of claim 2, wherein the maximum value is 0.5% or 0.3% of a full-scale range of light intensity.

4. The method of claim 1, wherein the output drive signal is a pulse-width modulated signal and wherein the change increment for the output drive signal comprises a change to a pulse-width modulated duty cycle.

5. The method of claim 1, further comprising scaling the dimming signal to match input requirements of an analog-to-digital converter.

6. The method of claim 1, further comprising averaging the dimming signal to reduce noise therein.

7. The method of claim 1, further comprising receiving a signal to cease dimming, and in response thereto, maintaining the output drive signal at a substantially constant value.

8. The method of claim 7, wherein the signal to cease dimming comprises (i) a cessation in the signal to initiate dimming, (ii) a cessation in change of the signal to initiate dimming, or (iii) a cessation signal different from the signal to initiate dimming.

9. The method of claim 1, further comprising:

repeating steps (B)-(D) until a signal to cease dimming is received, and in response thereto, maintaining the output drive signal at a substantially constant value.

10. A control system for controlling changes in light intensity in an illumination system that emits light in response to an output drive signal, the control system comprising:

a controller for (i) receiving a dimming initiation signal, (ii) determining a present value of the output drive signal or a present illumination level of light emitted by the illumination system, (iii) computing a change increment for the output drive signal based on the present value of the output drive signal or the present illumination level, wherein the change increment is (a) a first value if the present value of the output drive signal or the present illumination level is less than a threshold and (b) a second value greater than the first value if the present value of the output drive signal or the present illumination level is greater than the threshold, and (iv) changing the output drive signal by the change increment.

11. The control system of claim 10, wherein the controller is configured to receive a signal to cease dimming, and in response thereto, maintain the output drive signal at a substantially constant value.

12. The control system of claim 11, wherein the signal to cease dimming comprises (i) a cessation in the signal to initiate dimming, (ii) a cessation in change of the signal to initiate dimming, or (iii) a cessation signal different from the dimming initiation signal.

13. The control system of claim 10, further comprising a conditioner for modifying the output drive signal to match the input requirements of a driver.

14. The control system of claim 10, further comprising a driver for driving one or more light-emitting diodes based on the output drive signal.

15. The control system of claim 10, wherein the output drive signal is a pulse-width modulated signal and wherein the change increment for the output drive signal comprises a change to a pulse-width modulated duty cycle.

* * * * *